United States Patent [19]

Bradshaw

[11] 4,021,946

[45] May 10, 1977

[54] MULTIELEMENT CHANGEABLE SIGN DISPLAY

[75] Inventor: James T. Bradshaw, Lake Dallas, Tex.

[73] Assignee: F & M Systems, Co., a division of Fischbach and Moore, Incorporated, Dallas, Tex.

[22] Filed: May 29, 1975

[21] Appl. No.: 581,943

Related U.S. Application Data

[63] Continuation-in-part of Ser. No. 511,511, Oct. 3, 1974, abandoned.

[52] U.S. Cl. ..... 40/33; 40/52 R; 40/77.7; 340/324 M

[51] Int. Cl.[2] ..... G09F 11/10

[58] Field of Search ..... 40/28 C, 33, 77.7, 77.6, 40/77.4, 52 R; 340/324 M, 336, 324 B; 192/70.15; 74/665 M, 665 L, 665 B, 665 P

[56] References Cited

UNITED STATES PATENTS

| | | | |
|---|---|---|---|
| 874,832 | 12/1907 | Charles | 40/33 |
| 1,461,047 | 7/1923 | Ray | 40/77.7 |
| 1,923,523 | 8/1933 | Whitney | 40/77.7 X |
| 2,736,113 | 2/1956 | Morrison | 40/77.7 |
| 3,003,268 | 10/1961 | Chan | 40/33 |
| 3,199,239 | 8/1965 | Reed | 40/77.7 |
| 3,307,170 | 2/1967 | Aoyama et al. | 340/324 M |

FOREIGN PATENTS OR APPLICATIONS

| | | | |
|---|---|---|---|
| 38,749 | 9/1909 | Germany | 74/665 M |

*Primary Examiner*—John F. Pitrelli
*Attorney, Agent, or Firm*—Richards, Harris & Medlock

[57] ABSTRACT

A sign display comprises a plurality of triangular display elements each having three display surfaces. The display elements are arranged along mutually perpendicular sets of axes to define a matrix display having a display plane. Rotary drive shafts extend through the display element parallel to the display surfaces, and each display element includes clutch structure comprising frustoconical clutch members received in frustoconical apertures formed in the display element and spring biased to normally coupled the display element for rotation with the drive shaft extending therethrough. Abutment surfaces corresponding to the display surfaces project from the lower end of each display element, and a stop arm is associated with each display element for selective actuation to terminate rotation of the display element with a predetermined display surface situated in the display plane. The first display surfaces all of the display elements may be utilized in combination to form a dedicated sign and the second and third display surfaces of each display element may comprise contrasting colors, in which case the second and third surfaces of the display elements are utilized to form a desired sign by means of a matrix display.

41 Claims, 16 Drawing Figures

MULTIELEMENT CHANGEABLE SIGN DISPLAY

RELATED APPLICATIONS

This case is a continuation-in-part of Ser. No. 511,511, filed Oct. 3, 1974, and entitled "SIGN DISPLAY", now abandoned.

FIELD OF THE INVENTION

This invention relates to a sign display, and more particularly relates to apparatus adapted for the display of both dedicated signs and desired messages.

THE PRIOR ART

The use of large roadside signs or billboards has been known since the advent of the automobile. One difficulty that has been experienced in the use of these signs is the expense and time required in order to change the displayed message. This situation has led to a number of quite divergent systems for providing variable information on large roadside signs or billboards.

For example, various arrangements of lights have been provided on signs for displaying the time, the temperature, the latest stock market averages, etc. Signs have also been provided with apparatus for receiving alphanumeric characters in the manner of a movie marquee. Still another arrangement has been to provide a number of display elements adapted for rotation to position different display surfaces in a display plane. For example, signs have been provided with triangular display elements adapted for rotation about vertical axes. By this means a series of three different signs are sequentially displayed.

Each of the foregoing sign arrangements has enjoyed substantial commercial success. However, a need exists for still further improvements in the art of sign displays. For example, it has not heretofore been possible to selectively display either a dedicated sign or a desired variable message. That is, most prior art arrangements for facilitating the display of a desired message have been permanent in nature, and have thereby eliminated the possibility of the use of the same area for the display of a dedicated sign or of the display of a changing sign. Another requirement which has not been completely satisfied by the prior art is that of a sign adapted for the display of desired messages which is economical to construct and operate, but which is nevertheless adapted for long term, substantially maintenance free service.

SUMMARY OF THE INVENTION

The present invention comprises a sign display which fulfills the foregoing and other requirements long since found wanting in the prior art. In accordance with the broader aspects of the invention, a plurality of display elements are mounted along mutually perpendicular rows and columns to define a matrix display plane. Each display element has at least two display surfaces which are of contrasting colors. Structure is provided for rotating the display element about axes extending in one of the perpendicular directions, and for selectively terminating the rotation of individual display elements with a predetermined display surface thereof situated in the display plane. In this manner a desired sign is formed by means of a matrix display.

The display elements of the sign display are preferably triangular in cross-section and have three display surfaces. The first display surfaces of all of the display elements may be utilized in combination to form a dedicated sign. The second and third display surfaces of each display element may comprise predetermined contrasting colors. In such instances the second and third display surfaces are selectively positioned in the display plane to exhibit a desired message, while all of the first display surfaces are simultaneously positioned in the display plane to exhibit a dedicated sign.

In accordance with more specific aspects of the invention, the display elements are arranged in rows and columns and a rotary drive shaft extends through each column of display elements. The drive shafts are adapted for rotation in either direction, and may be driven by motors individual thereto. Alternatively, the drive shafts may be rotated by a single motor which is coupled to the drive shafts by suitable transmission means. In the case of sign displays utilizing relatively large display elements, alternate columns of display elements are arranged for rotation out of phase with the rotation of adjacent display elements. This is to prevent possible interference between the display elements during rotation thereof.

The display elements are coupled for rotation with the drive shaft extending therethrough by means of clutches individual to the display element. Each clutch includes a pair of frustoconical apertures formed in the opposite ends of one of the display elements and a pair of frustoconical clutch members received in the frustoconical apertures. Each clutch member is connected to the drive shaft and one of the frustoconical clutch members is spring biased into its respective frustoconical aperture.

Each of the display elements is provided with locating members adapted for selective engagement to terminate the rotation of the display element with a predetermined display surface thereof in the display plane. The locating members may comprise abutment surfaces projecting axially from the end of the display element, in which case a stop arm is provided for engagement with the abutment surfaces to terminate rotation of the display element. The stop arm is preferably pivotally supported for movement between positions wherein it controls the rotational positioning of the display element.

DESCRIPTION OF THE DRAWINGS

A more complete understanding of the invention may be had by reference to the following Detailed Description when taken in conjunction with the accompanying Drawings, wherein.

DETAILED DESCRIPTION

Figure 1:
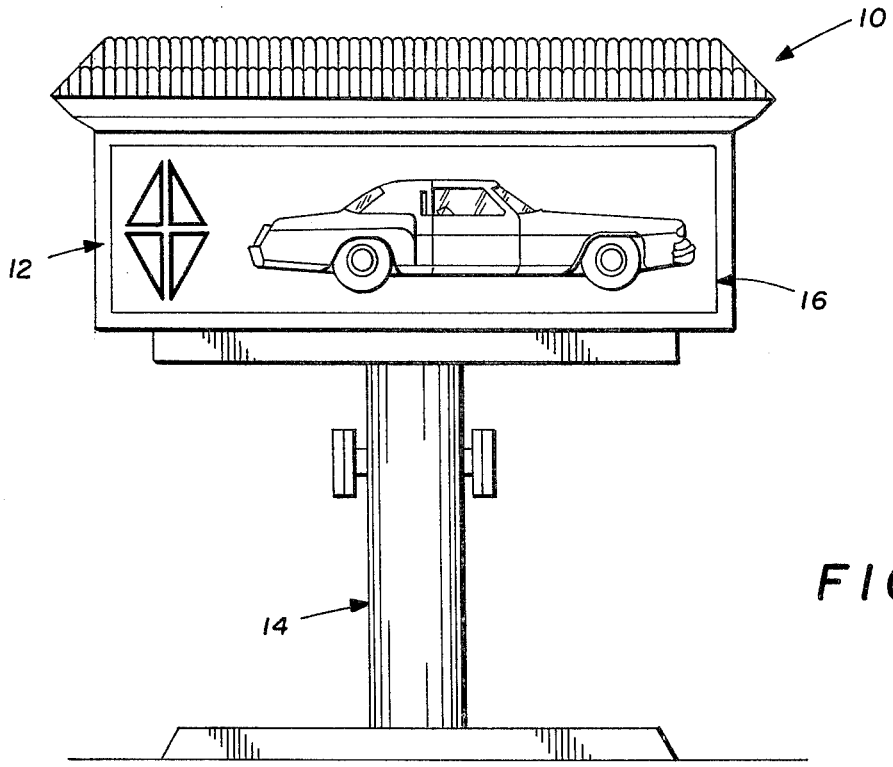
FIG. 1 is an illustration of a sign display incorporating the invention showing the use of the sign display in the display of a dedicated sign.

Referring now to the Drawings, and particularly to FIG. 1 thereof, there is shown a sign display 10 incorporating the invention. The sign display 10 includes a housing 12 mounted on a suitable support 14. Any of the various conventional sign support techniques may be utilized in the practice of the invention. Moreover, the sign display 10 may incorporate any of the various conventional sign illumination systems.

The housing 12 comprises a rectangular display area 16 defining a display plane. The display area 16 actually comprises a plurality of vertical columns and a plurality of horizontal rows of display elements. For example, in one embodiment of the invention the display area 16 comprises 120 vertical columns and 27 horizontal rows of display elements, each approximately 3 inches by 3 inches. In the use of the sign display 10, the display elements are selectively positioned relative to the display plane of the display area 16 to either display a dedicated sign in the manner illustrated in FIG. 1, or to display any of various desired messages in the manner illustrated in FIGS. 2 and 3.

Figure 6:
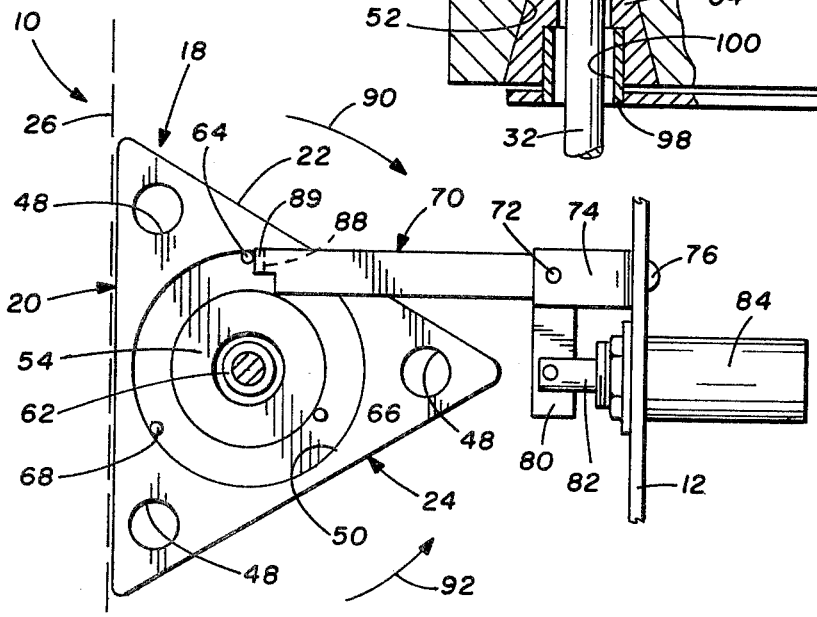
FIG. 6 is a top view further illustrating the construction and operation of the display element of FIG. 5.

Turning now to FIG. 6, the sign display 10 of the present invention incorporates a multiplicity of individual display elements 18. The display elements 18 are triangular in cross-section and each comprise three display surfaces 20, 22 and 24. In the practice of the invention the various display surfaces 20, 22 and 24 of each display element 18 are selectively positioned in a display plane 26 which is coincident with the display area 16 as shown in FIGS. 1, 2 and 3.

Referring simultaneously to FIGS. 1 and 6, the display surfaces 20 of the display elements 18 comprising the sign display 10 are utilized to display a dedicated sign in the manner illustrated in FIG. 1. Thus, whenever it is desired to display the dedicated sign, the display surfaces 20 of all of the display elements 18 comprising the sign display 10 are simultaneously positioned in the display plane 26 and hence in the display area 16 as shown in FIG. 1. The dedicated sign is a typical billboard type sign and may comprise any desired color or colors, any desired shape, as much or as little alphanumeric information as may be required by particular circumstances, etc. Moreover, the positioning of the various component parts of the dedicated sign is completely independent of the relative positioning of the display elements in the sign display 10, since a particular portion of the dedicated sign need not begin or terminate in accordance with the edges of the display element.

Figure 2:
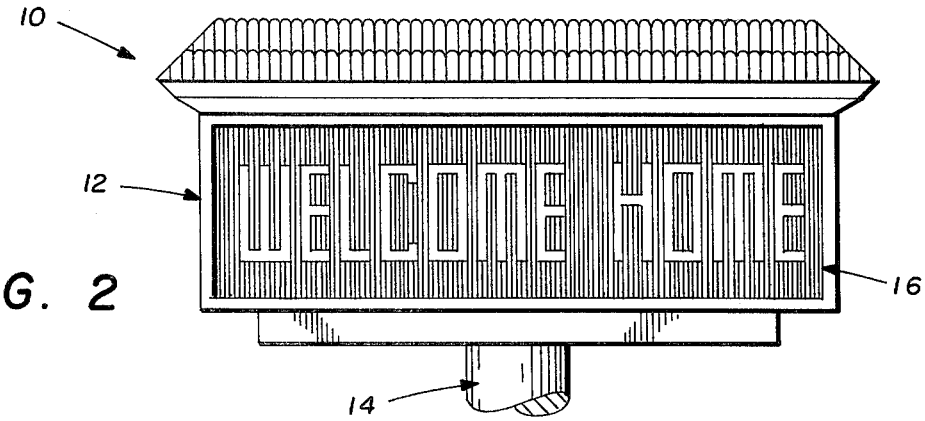
FIG. 2 is an illustration of the sign of FIG. 1 showing the use of the sign display in the display of a desired message.
Figure 3:
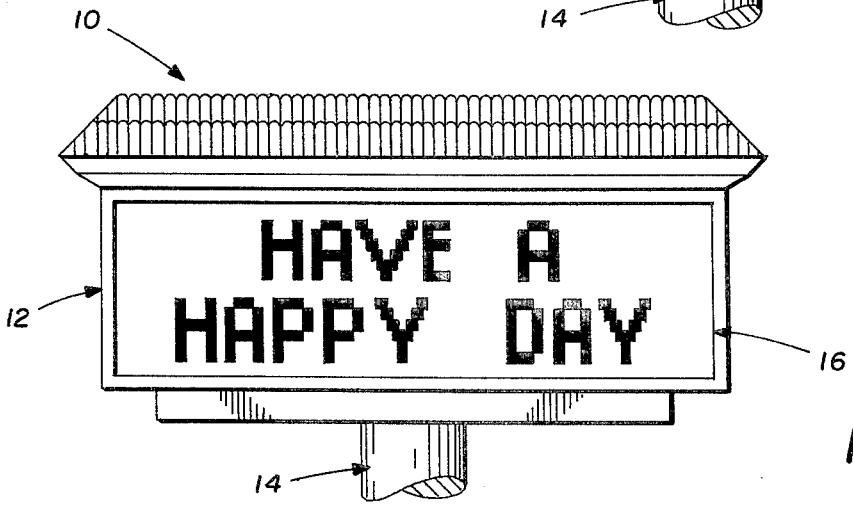
FIG. 3 is an illustration of the sign display of FIG. 1 showing the use thereof in the display of a different desired message.

Referring simultaneously to FIGS. 2, 3 and 6, the display surfaces 22 and 24 of the display elements 18 comprise contrasting colors. For example, the display surfaces 22 of all of the display elements 18 may be black, and the display surfaces 24 of all of the display elements 18 may be yellow. Other contrasting colors may also be used on the display surfaces 22 and 24.

In order to exhibit a desired message in the display area 16 of the sign display 10, the display surfaces 22 and 24 of the display elements 18 are selectively positioned in alignment with the display plane 26 to form the desired message by means of a matrix display. As is well known, matrix display techniques may be utilized to form literally any alphanumeric character. In this manner, a desired message is formed and displayed in the display area 16 of the sign display 10. The desired message may also include various designs, with the determination as to whether or not a particular design can be exhibited depending on the complexity of the design and the resolution of the matrix display system.

FIGS. 2 and 3 further illustrate the flexibility of the sign display of the present invention. In FIG. 2 the desired message is formed in block letters and comprises light characters on a dark background. In FIG. 3 the characters have a more curved appearance and comprise dark characters on a light background. Again, the only limitations that are encountered in forming the desired message by means of the present invention are those of size and resolution.

Figure 4:
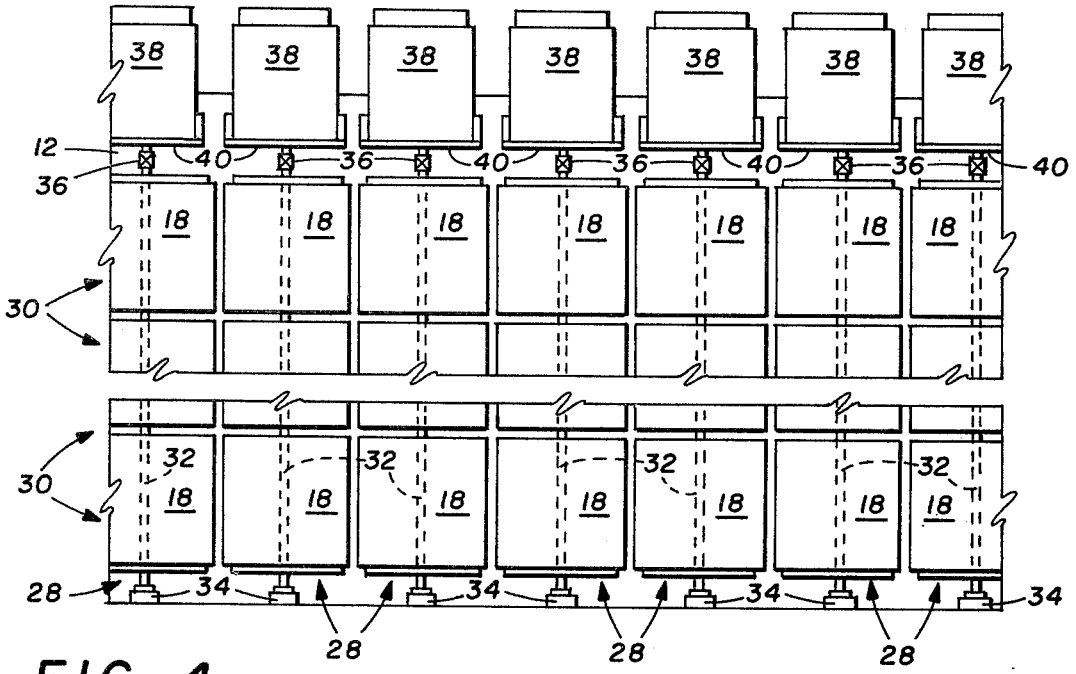
FIG. 4 is a more detailed illustration of one embodiment of the sign display of FIG. 1.

As is best shown in FIG. 4, the display elements 18 of the sign display 10 are arranged in a rectangular matrix comprising vertical columns 28 and horizontal rows 30. The display elements 18 are mounted for rotation about vertical axes defined by dirve shafts 32. Those skilled in the art will appreciate the fact that the drive shafts 32 may extend horizontally rather than vertically, if desired.

The lower end of each drive shaft 32 is rotatably supported in a thrust bearing 34. The upper end of each drive shaft 32 is connected through a flexible coupling 36 to a drive motor 38 mounted on a bracket 40. The motors 38 may comprise electric motors, pneumatic motors, hydraulic motors, etc. in accordance with particular requirements.

Upon actuation of the motors 38, the drive shafts 32 are rotated to effect rotation of the display elements 18. One advantage to the use of multiple motors 38 in the sign display 10 is that either the dedicated sign or a particular desired message may be formed progressively across the width of the display area 16 by operating the motors 38 in sequence. Adjacent motors 38 may also be operated sequentially so as to prevent possible interference between the display elements during the rotation thereof.

Figure 5:
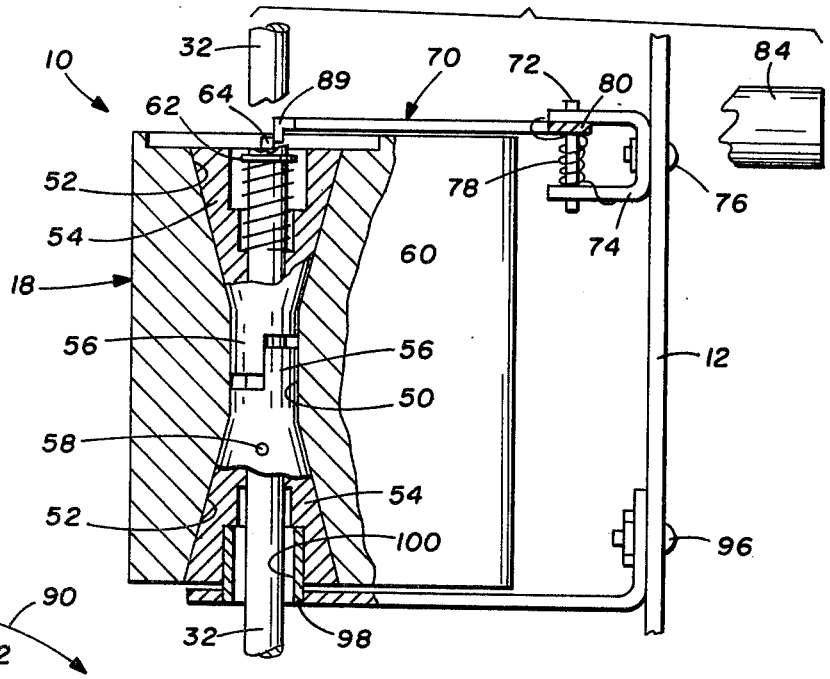
FIG. 5 is a partial sectional view showing the construction of one of the display elements of the sign display.

Referring to FIGS. 5 and 6, the display elements 18 of the sign display 10 are preferably formed from a material having good ultraviolet light resistance, and good wear resistance. For example, various plastic materials such as delrin, phenylene oxide, acetal, and the like may be utilized to fabricate the display elements 18. The display elements 18 may be provided with axially extending holes 48 formed in the corners thereof to reduce rotational inertia. Each display element 18 further includes a central bore 50.

The central bore 50 of each display element 18 comprises opposed frustoconical portions 52. Frustoconical clutch members 54 formed from a suitable plastic material are received in the frustoconical portions 52 of the bore 50. The clutch members 54 have end portions 56 which are semicircular in cross-section, and which mate together to prevent relative rotation between the clutch members 54 while permitting relative axial movement therebetween and thereby accommodating wear.

The lower frustoconical clutch member 54 of each set is secured to the drive shaft 32 extending through the display element 18 by means of a pin 58. The upper frustoconical clutch member 54 of each set is biased into its respective frustoconical portion 52 of the bore 50 by a spring 60. The spring 60 is a compression spring and is mounted between the upper frustoconical clutch member 54 and a retaining member 62 secured to the shaft 32. Therefore, since the lower frustoconical clutch member 54 is pinned to the shaft 32, since the end portions 56 prevent relative rotation between the frustoconical clutch members, and since the upper frustoconical clutch member 54 is biased into frictional engagement with the display element 18 by the spring 60, the display element 18 is normally rotated with the drive shaft 32 under the action of the drive motor 38.

A plurality of locating pins 64, 66 and 68 project axially outwardly from the upper end of the display element 18. The pins 64, 66 and 68 correspond to the positioning of the display surfaces 20, 22 and 24 in alignment with the display plane 26, respectively. It will be noted that whereas the pins 64 and 68 are positioned on an outer diameter relative to the axis of rotation of the display element 18 as defined by the drive shaft 32, the pin 66 is positioned on an inner diameter relative to the axis of rotation of the display element 18.

Figure 8:
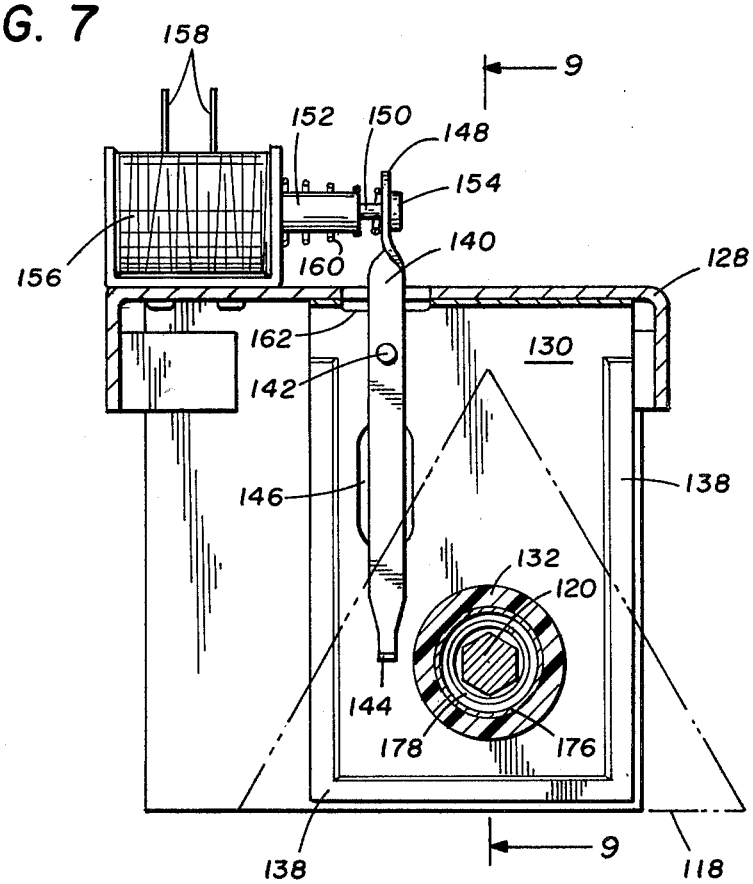
FIG. 8 is a sectional view taken generally along the section lines 8—8 in FIG. 7, with the triangular sign display removed for clarity of illustration.

The rotational positioning of each display element 18 relative to the display plane 26 under the action of the drive shaft 32 is regulated by a stop arm 70. The stop arm 70 is pivotally supported on a shaft 72 which is in turn supported on a U-shaped bracket 74. The bracket 74 is secured to the housing 12 by a fastener 76. A torsion spring 78 is mounted on the shaft 72 and is connected between the stop arm 70 and the bracket 74. The spring 78 normally positions the stop arm 70 as shown in FIG. 8.

The stop arm 70 comprises a bell crank and includes an arm 80 which is pivotally connected to the plunger 82 of a solenoid 84. The spring 78 normally positions the stop arm in the path of rotation of the pins 64 and 66 of the display element 18. Upon actuation of the solenoid 84, the stop arm 70 is pivoted inwardly and is positioned in the path of rotation of the pin 66.

The stop arm 70 associated with each display element 18 has two locating surfaces 86 and 88 comprising the opposite sides of a depending tab 89. The locating surface 86 of each stop arm 70 is adapted for engagement with the locating pins 64 of the associated display element 18. Conversely, the locating surface 88 of each stop arm 70 is adapted for engagement with the locating pins 66 and 68 of the associated display element 18.

Assuming that it is desired to actuate the sign display 10 to display the dedicated sign in the manner illustrated in FIG. 1, the drive shafts 32 are actuated to rotate all of the display elements 18 of the sign display 10 in the direction of the arrow 90. This causes the locating pin 64 of the display elements 18 to engage the locating surfaces 86 of the stop arm 70, whereby the display surfaces 20 of the display elements 18 are positioned in alignment with the display plane 26, and hence in the display area 16 of the sign display 10. It will be appreciated that it is not necessary to actuate any of the solenoids 84 in order to display the dedicated sign in the display area 16 of the sign display 10.

Assuming that it is desired to display a desired message in the display area 16 of the sign display 10, the drive shafts 32 are actuated to rotate the display elements 18 of the sign display 10 in the direction of the arrow 92. If the display surface 22 of a particular display element 18 is to be aligned with the display plane 26, the associated solenoid 84 is actuated to pivot the tab 89 inwardly. The locating pin 66 therefore engages the locating surface 88, whereby rotation of the display element is terminated with the display surface 22 aligned with the display plane 26, and hence in the display area 16 of the sign display 10. On the other hand, if the display surface 24 of a particular display element 18 is to be aligned with the display plane 26, the associated solenoid is not actuated. With the solenoid 84 thus de-energized, the spring 78 positions the stop arm 70 and the locating surfaces 88 thereof for engagement with the locating pin 68. By this means rotation of the display element 18 in the direction of the arrow 92 is terminated when the display surface 24 is positioned in alignment with the display plane 26 and hence in the display area 16 of the sign display 10. It will thus be understood that the only time that it is necessary to actuate the solenoids 84 is when it is desired to display one or more of the display surfaces 22 in the display area 16.

Referring specifically to FIG. 5, it will be noted that since the lower frustoconical clutch member 54 is received in the corresponding frustoconical portion 52 of the bore 50 and is in turn pinned to the drive shaft 32, the display element 18 is supported on the drive shaft 32. In the case of columns 28 containing a relatively large number of display elements 18, it is considered desirable to provide additional support for the display elements 18 as well as to maintain alignment of the drive shaft 32. To this end, a bracket 94 is secured to the housing 12 by means of a fastener 96. A sleeve 98 is mounted on the bracket 94 and is received in a corresponding aperture 100 formed in the lower frustoconical clutch member 54 of the display element 18. It has been found that if brackets 94 are utilized in conjunction with every third or fourth display element in each column, the desired additional stability and support is provided in the overall structure of the sign display 10.

Figure 7:
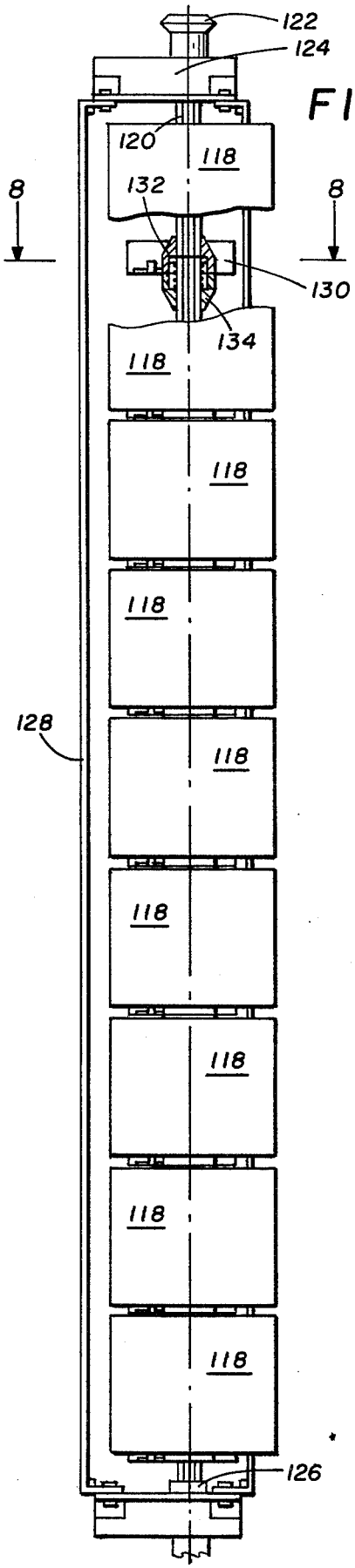
FIG. 7 is a side view, partially broken away, of one column of the preferred embodiment of the sign display.

FIGS. 7–16 illustrate the preferred embodiment of the present invention. FIG. 7 is a side view of one column of a sign display utilizing nine preferred display elements 118 which are mounted along a vertical drive shaft 120. Each of the display elements 118 is provided with a triangular configuration to provide three display surfaces in the manner previously described. A miter gear 122 is attached to the top end of the drive shaft 120 in order to receive rotative drive in the manner to be subsequently described. Drive shaft 120 is journaled within a support member 124 at the top end thereof and within a bearing member 126 at the lower end thereof. A support frame 128 supports the drive shaft 120 and also supports a plurality of support brackets 130 which are disposed below each display element 118. As will be subsequently described, each support bracket 130 includes a solenoid thereon which may be actuated in order to selectively position the associated display element 118.

Figure 11:
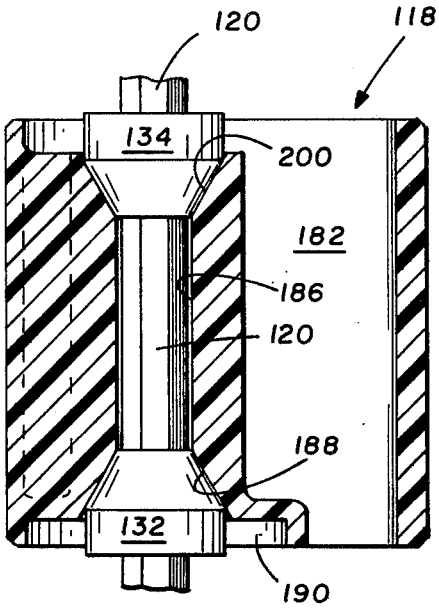
FIG. 11 is a cross-section of one of the preferred display elements in accordance with the invention.

Each display element 118 includes upper and lower clutch members associated therewith in order to provide drive to the display element 118 from the drive shaft 120. As shown in FIG. 7 and FIG. 11, a lower clutch member 132 is associated with each display element 118, with an upper clutch element 134 also associated with each display element 118.

Figure 9:
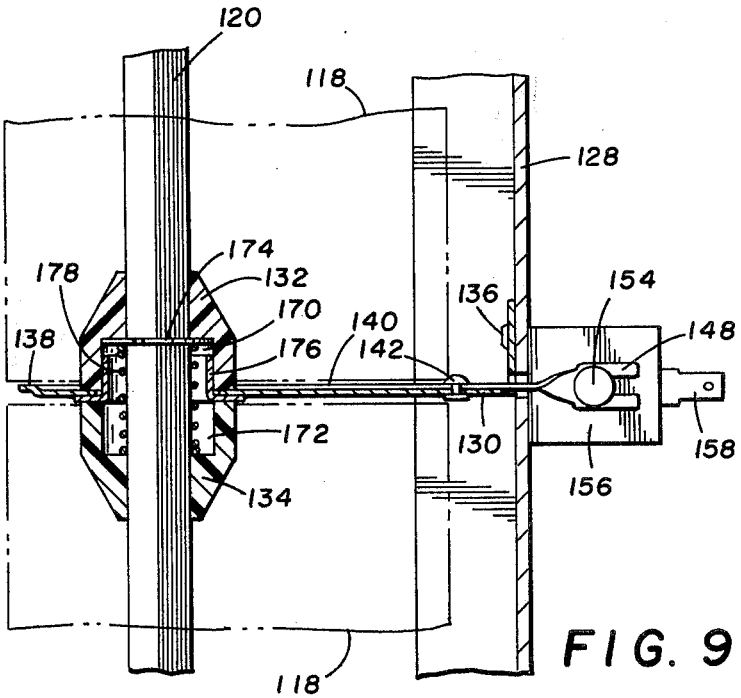
FIG. 9 is a sectional view taken generally along the section lines 9—9 in FIG. 8.

FIGS. 8 and 9 illustrate in greater detail the support bracket 130 which has an upturned flange attached by rivets 136 to the support frame 128. Support bracket 130 comprises a generally rectangular member having a slightly raised flange 138 extending about the periphery of three sides. A circular aperture is formed through the support bracket 130 to receive a hexagonal shaped drive shaft 120. A lower clutch member 132 includes a center aperture therethrough having the shape of a hexagon for closely receiving the drive shaft 120. Clutch member 132 thus is caused to rotate by rotation of the drive shaft 120. The triangular display element 118 is disposed above the support bracket 130 as evidence by the dotted lines.

A stop arm 140 is pivotally mounted on a pivot 142 to the support bracket 130. The stop arm 140 includes at the forward end an upwardly extending tab 144. In the manner previously described, either side of the tab 144 serves as a locating surface in order to selectively position the display element 118. An elongated aperture 146 is formed through the support bracket 130 in order to eliminate drag of the stop arm 140 against the support bracket 130, and also to allow drainage of water or other debris which might otherwise accumulate in an outside sign display.

The rearward end of the stop arm 140 includes an open ended yoke member 148 which receives a shaft 150 of a solenoid pin 152. The end 154 of the pin 152 has an enlarged diameter to prevent disengagement of the yoke 148 therefrom. A solenoid 156 includes terminals 158 for receiving electrical signals to provide actuation thereof. A spring 160 is disposed between the body of the solenoid 156 and the yoke member 148 in order to normally bias the solenoid pin 152 in the de-energized state to the illustrated outwardly extended position. The solenoid 156 is attached by rivets to the support frame 128. The stop arm 140 extends through a slot 162 formed through the upturned flange of the support bracket 130. It will be understood that when the solenoid 156 is energized, the pin 152 is pulled inwardly, thereby causing the stop arm 140 to pivot about the pivot 142. Movement of the stop arm 140 causes the tab 144 to be located against an abutment surface of the display element 118 in order to selectively position the element 118 in the desired position.

FIG. 9 illustrates in greater detail the clutch structure of the invention. Referring to FIG. 9, it will be seen that each of the upper and lower clutch members 132 and 134 have frustoconical cross-sections. Each of the clutch members has a six sided aperture extending through the center thereof in order to closely receive the hexagonal shaped drive shaft 120. Clutch members 132 and 134 thus rotate with the drive shaft 120. Each of the clutch members 132 and 134 include circular base portions with counterbores 170 and 172 formed therein respectively. Clutch members 132 and 134 are preferably formed from rigid thermoplastic material.

An important aspect of the present invention is that, for each display element 118, a snap ring 174 is fitted within a suitable groove about the drive shaft 120. The snap ring 174 is received within the circular counterbore 170 of clutch member 132 and thus serves to support the lower clutch member 132 and the corresponding display element 118. A circular upturned flange 176 extends from the support bracket 130 and is also closely received within the interior of the counterbore 170 to position the shaft 120 and the clutch member 132 in the desired position relative to the support bracket 130.

A spring 178 abuts against the underside of the snap ring 174 and extends along shaft 120 into abutment with the lower end of the counterbore 172 in the clutch member 134. Inasmuch as the snap ring 174 is rigidly attached to rod 120, spring 178 provides a downward bias against the clutch member 134. The clutch member 134 is received in a frustoconical aperture within the lower display element 118 as shown in FIG. 11, and thus causes the display element 118 to normally rotate with rotation of the drive shaft 120. However, when the display element 118 is stopped in the manner to be subsequently described, the display element will overcome the bias exerted by the spring 178 and will slip relative to the clutch member 134.

FIG. 9 also illustrates the yoke member 148 formed in the rearward end of the stop arm 140. As previously described, yoke member 148 receives the shaft 150 of pin 152 and is maintained in position by end 154.

Figure 10:
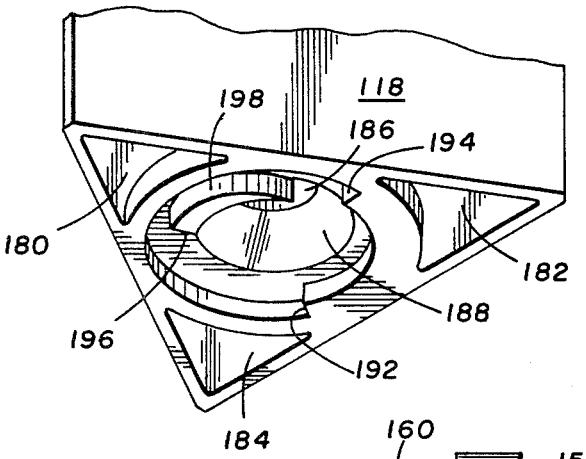
FIG. 10 is a perspective view of the bottom of one of the triangular display elements of the preferred embodiment.

FIG. 10 illustrates the underside of one of the display elements 118. Apertures 180, 182 and 184 are formed through the display element 118 to provide for weight reduction. An important aspect of the present invention is the provision of three abutment surfaces on the underside of the display element 118 in order to allow for selected positioning of the display element 118. An aperture 186 extends completely through the center of the display element 118. As best shown in FIG. 11, a frustoconical surface 188 extends downwardly from the aperture 186 to a counterbore 190 in the bottom of the display element. A first abutment surface 192 and a second abutment surface 194 are formed on the outer periphery of the counterbore. A third abutment surface 196 is formed on the inner edge where the counterbore and the frustoconical surface 188 meet. A cam surface 198 extends from the third abutment surface 196.

Referring specifically to FIG. 11, it will be seen that each display element 118 includes an upper frustoconical surface 200. A clutch member 132 is received by the frustoconical surface 200, while a clutch member 134 is received by the frustoconical surface 188. Inasmuch as the clutch member 132 is downwardly biased by spring 178 as shown in FIG. 9, normally the display element 118 rotates upon rotation of the drive shaft 120. However, when the display element 118 is stopped by abutment of the tab 144 against one on the abutment surfaces 192, 194 or 196, the display element 118 slips relative to the clutch members 132 and 134. The display element 118 is preferably formed from the same material as previously noted and may be suitably formed by injection molding or other molding techniques.

Figure 12:
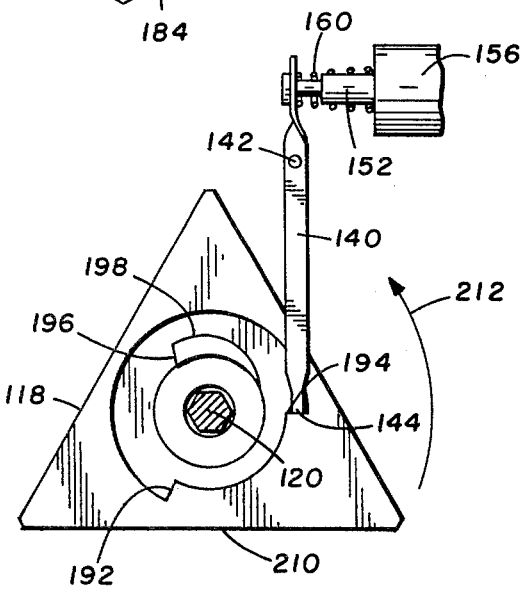
FIGS. 12–14 are bottom views of one of the triangular display elements shown in conjunction with the stop arm illustrating how each of the three sides of the element are selectively displayed.
Figure 13:
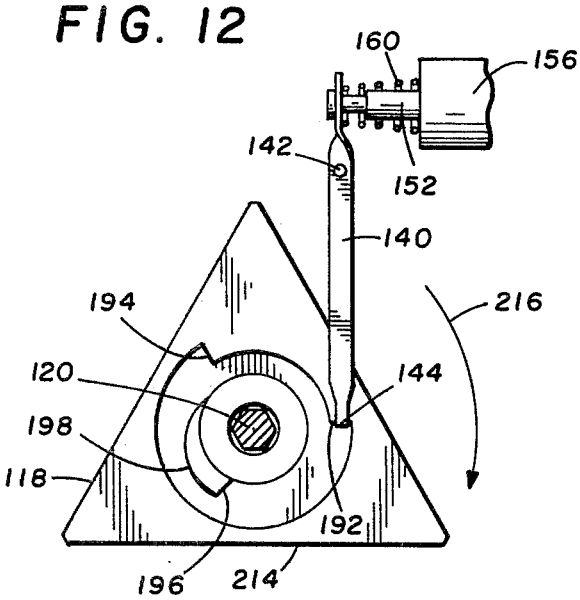
Figure 14:
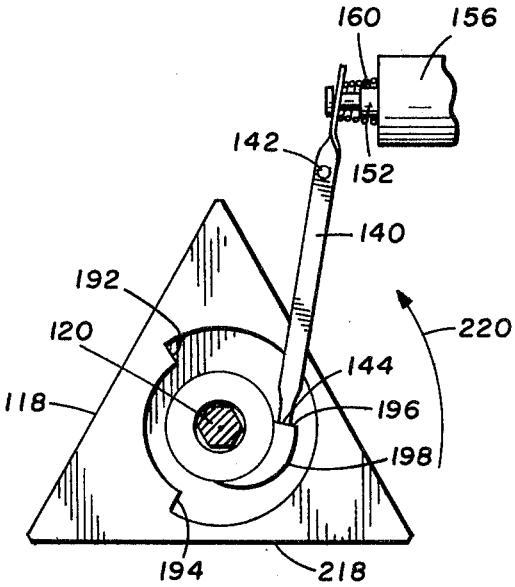

FIGS. 12, 13 and 14 illustrate how the display element 118 is selectively positioned by operation of the solenoid 156 and the stop arm 140. Referring to FIG. 12, it will be assumed that it is desirable to position for view display surface 210 of the display element 118.

The drive shaft 120 is rotated in the direction illustrated by the arrow 212 as seen from the bottom of the display element 118, and the solenoid 156 is in its de-energized position. The spring 160 causes the pin 152 to be extended in the manner shown. This causes the stop arm 140 to be positioned such that the outside locating surface of the tab 144 abuts against the abutment surface 194. Display element 118 then slips relative to rotating clutch members 132 and 134. In this manner, display surface 210 is selectively positioned for view.

Referring to FIG. 13, when the display surface 214 is desired to be displayed, the drive shaft 120 is rotated in the direction shown by the arrow 216 and the solenoid 156 is again de-energized. In this position, the inner locating surface of the tab 144 of the arm 140 abuts against the abutment surface 192. This causes slippage of display element 118 relative to clutch members 132 and 134 such that the display surface 214 is selectively positioned for view. In the preferred embodiment, the display surface 214 will comprise the dedicated sign portion of the display.

Referring to FIG. 14, when display surface 218 is desired to be displayed, the solenoid 156 is energized by the application of a suitable electrical signal. This causes the shaft 152 to be retracted in the manner illustrated. The stop arm 140 is pivoted about the pivot point 142. When the display element 118 is rotated in the direction illustrated by the arrow 220, the tab 144 moves along the groove until the outer surface of the tab 144 abuts against the abutment surface 196. This causes slippage between the display element 118 and the clutch members in the manner previously described. Thus, the drive shaft 120 continues rotation for a period, while the display element 118 is maintained in the desired position. The cam surface 198 prevents stoppage of the display element 118 when the element is rotating opposite the direction of arrow 220.

In the preferred embodiment, the drive shaft 120 is rotated approximately one revolution each time it is desired to change one or more display elements 118 mounted thereon. Due to the placement of the abutment surfaces 192, 194 and 196, it is not possible to rotate a display element 118 more than approximately two-thirds of a revolution before abutment with the stop arm 140. Thus, the drive shaft 120 continues rotation for at least one-third of a revolution after slippage occurs between the display element 118 and the clutch members 132 and 134. After completion of a revolution, the drive shaft 120 terminates rotation until it is desired to again change position of one or more of the display elements mounted upon the drive shaft.

It will thus be seen that it is possible to selectively display any display surface of any display element mounted upon a drive shaft of the invention. To display the dedicated sign, no energization of the solenoid is required, and only rotation of the drive shaft in the predetermined direction is required. Thus, the display of the dedicated sign may be displayed at all times, even assuming some malfunction of one of the solenoids.

Figure 15:
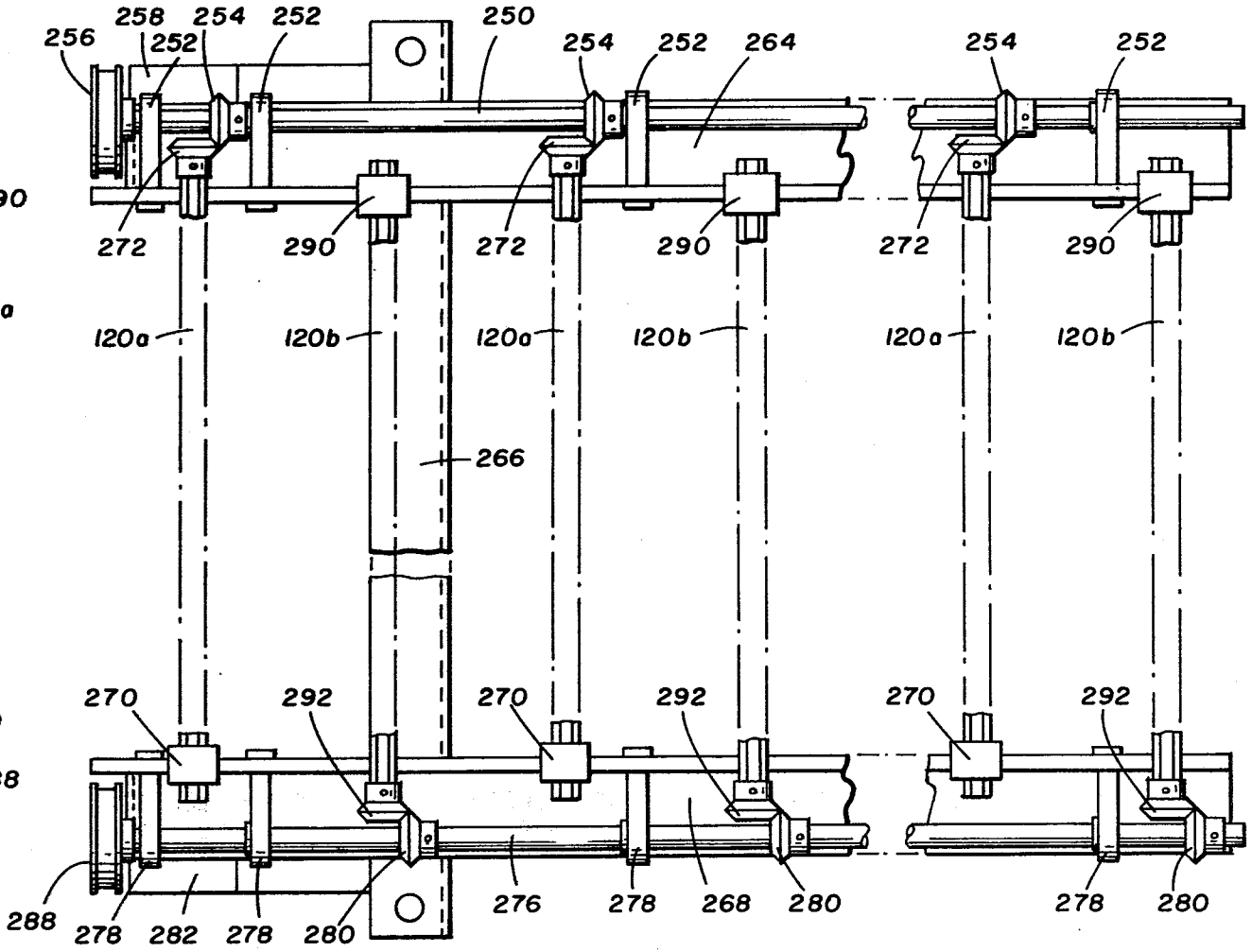
FIG. 15 is a front view, partially broken away, of the drive shaft mechanism of the preferred embodiment.
Figure 16:
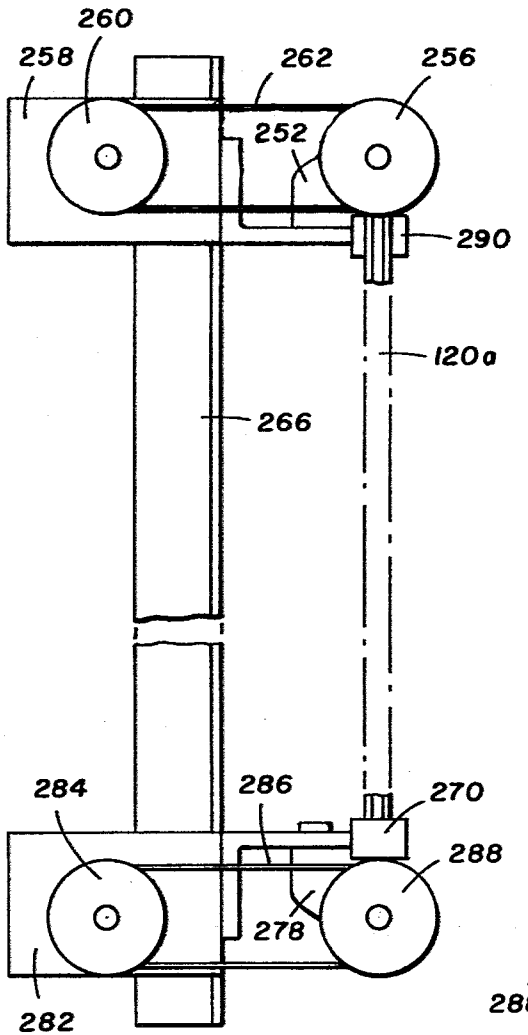
FIG. 16 is a side view of the drive structure shown in FIG. 15.

It is important that reversible motors be utilized with the invention is order to provide two-way rotation of the drive shafts of the invention. In addition, it is desirable to enable selective rotation of adjacent drive shafts so as to prevent any interference between edges of horizontally exposed display elements. FIGS. 15 and 16 illustrate a drive mechanism for providing drive to the present invention. Referring to FIG. 15, a horizontal drive shaft 250 is mounted in bearings in supports 252 for rotation. Miter gears 254 are mounted at selected points along the upper horizontal drive shaft 250. Rotation is provided to the drive shaft 250 through a pulley 256 which is driven by a motor 258 shown in FIG. 16. Motor 256 operates an output shaft 260 which provides drive to pulley 256 through a timing belt 262. Motor 258 may comprise any suitable type of reversible electrical motor. Bearing supports 252 are mounted for a horizontal support member 264 which in turn are supported by one or more vertical supports 266. A lower support 268 is connected to the vertical support 266.

A plurality of drive shafts **120*a* constructed in the manner previously described are mounted in bearings 270 supported by lower support 268. Miter gears 272 are attached to the upper portion of each of the drive shafts 120*a* and mesh with the miter gears 254 previously described. Operation of motor 258 thus operates to provide rotation to drive shafts 120*a* in either of two positions. Display elements 118 are mounted along drive shafts 120*a* in the manner previously described, but are omitted from FIG. 15** for clarity of illustration.

A lower horizontal drive shaft 276 is mounted in bearings and supports 278. Miter gears 280 are mounted along shaft 276. Drive is provided to shaft 276 from a motor 282. As shown in FIG. 16, motor 282 operates an output pulley 284 which provides drive through a timing belt 286 to a pulley 288. Pulley 288 causes rotation of shaft 276.

A plurality of drive shafts **120*b* are mounted in bearings 290. Miter gears 292 are affixed to the lower ends of the shaft 120*b* and mesh with miter gears 280. Operation of motor 282 can then provide selective two-way rotation of the drive shafts 120*b*. Operation of the motors 256 and 288 may be coordinated by suitable electrical controls such that the alternating vertical drive shafts 120*a* and 120*b*** may be controlled so as to prevent interference between display elements mounted on the adjacent shaft.

It will be understood by reference to FIG. 15 that snap rings 174 are selectively positioned along the length of the vertical drive shafts **120*a* and 120*b* in order to supply support to the desired number of display elements 118 in the manner shown in FIG. 7**.

From the foregoing, it will be understood that the present invention comprises a sign display incorporating numerous advantages over the prior art. One of the most significant advantages deriving from the use of the invention is the ability to selectively either display a dedicated or a desired message in the same sign display. Another advantage to the use of the invention involves the fact that the component parts of the sign display are simple and economical to construct, and yet are adapted for long term, substantially maintenance free service. Other advantages deriving from the use of the invention will readily suggest themselves to those skilled in the art.

Although preferred embodiments of the invention have been illustrated in the accompanying drawings and described in the foregoing Detailed Description, it will be understood that the invention is not limited to the embodiments disclosed, but is capable of numerous rearrangements, modifications, and substitutions of parts and elements without departing from the spirit of the invention.

I claim:

1. A sign display comprising:

a plurality of display elements positioned in rows and columns to define a display matrix;

each of said display elements having a plurality of substantially planar display surfaces;

drive shaft means extending through the display elements of each column substantially parallel to the display surfaces thereof;

a pair of frusto conical clutch members disposed on opposite ends of each display element and each connected for rotation with said drive shaft means, one of said clutch members normally biased against an end of a display element for causing rotation of said display element with rotation of said drive shaft means, said clutch members comprising a pair of apertures having a predetermined configuration formed in the opposite ends of said display element;

said pair of clutch members being received in the apertures of said display element;

said drive shaft means extending through said frustoconical clutch members and said apertures;

means securing at least one of said clutch members to said drive shaft means for rotation therewith; spring means biasing one of said clutch members into frictional engagement with said display element; and means associated with each display element for selectively terminating rotation of said display element and for causing said clutch members to slip relative to said display element in order to position a predetermined display surface of said display element in a display plane.

2. The sign display according to claim 1 wherein said means for selectively terminating rotation of each display element is further characterized by:

a plurality of locating means each mounted on said display element for rotation therewith and each corresponding to the positioning of a predetermined display surface in the display plane; and stop means mounted for pivotal movement between first and second positions for engaging predetermined locating means to terminate rotation of the display element with a predetermined display surface thereof in the display plane.

3. The sign display according to claim 2 wherein said locating means comprises a plurality of abutment surfaces mounted on one end for rotation with said display element.

4. The sign display according to claim 3 wherein said display element is rotatable in either of two directions and wherein the engagement of said stop means with said abutment surfaces comprising the locating means depends on the pivotal positioning of said stop means and on the direction of rotation of said display element.

5. A sign display comprising:

a plurality of display elements mounted in rows and columns to define a display matrix characterized by a display plane;

each of the display elements having at least two display surfaces characterized by contrasting colors;

drive shaft means extending through the display elements of each of the columns of the display matrix for rotation about predetermined axes;

each of the display elements having opposed frustoconical apertures formed in the opposite ends thereof;

frustoconical clutch members received in each of the frustoconical apertures of the display elements for cooperation therewith to define clutch means for frictionally engaging the display elements with the drive shaft means for rotation therewith;

each of the frustoconical clutch members in each display element being secured for rotation with the drive shaft means extending therethrough but adapted for limited longitudinal movement relative to the axis of said drive shaft means, means biasing one of the frustoconical clutch members of each display element into its respective frustoconical aperture;

a plurality of locating members mounted for rotation with each display element and each corresponding to a display surface of the display element; and a plurality of stop mechanisms each individual to one of the display elements and each mounted for selective engagement with the locating members of the display element to selectively terminate rotation of the display element with a selected display surface thereof positioned in the display plane of the display matrix.

6. The sign display of claim 5 wherein said drive shaft means has at least one planar surface along the length thereof, each of said clutch members having an aperture therethrough with a planar surface for mating with said drive shaft means.

7. The sign display according to claim 5 wherein the locating members comprise abutment surfaces extending axially from one end of each display element, and wherein the stop mechanism includes an arm normally positioned in the rotational path of predetermined ones of the abutment surfaces and means for selectively pivoting the arm into the rotational path of predetermined abutment surfaces.

8. The sign display according to claim 7 wherein the arm comprises an L-shaped arm supported for pivotal movement about an axis extending parallel to the axis of rotation to the display element, and further including solenoid means for selectively pivoting the L-shaped arm about its axis of pivotal movement.

9. The sign display according to claim 8 wherein said L-shaped arm is mounted under a display element for abutment with said abutment surfaces disposed on the bottom of said display element.

10. The sign display according to claim 5 wherein each display element comprising first, second and third display surfaces, wherein the first display surfaces of all of the display elements cooperate to form a dedicated sign when they are aligned with the display plane, and wherein the second and third display surfaces of each display element comprise contrasting colors.

11. The sign display according to claim 5 and further comprising:

washer means rigidly attached along said drive shaft means for supporting the lower one of said clutch members associated with each said display element.

12. The sign display according to claim 5 wherein said locating members comprise:

grooves formed in one end of each of said display elements and including abutment surfaces each corresponding with a particular display surface.

13. The sign display according to claim 12 and further comprising a cammed surface leading to one of said abutment surfaces to prevent terminating rotation of said display element in one direction of rotation.

14. A sign display comprising:

a plurality of display elements positioned along rows and columns extending in perpendicular directions to define a matrix display characterized by a display plane;

each of the display elements being triangular in cross-section and having first, second and third display surfaces;

the first display surfaces of all of the display elements comprising in combination a dedicated sign having predetermined indicia thereon;

the second display surfaces of each display element comprising a first predetermined color;

the third display surface of each display element comprising a second predetermined, contrasting color;

drive shafts extending vertically through each column of the display elements for rotation about the vertical axes;

a first motor mounted at the top of said display plane and a second motor mounted at the bottom of said display plane;

first and second output shafts extending horizontally from each of said motors;

first gears spaced along said first output shaft for engagement with the tops of alternate ones of said drive shafts to cause rotation thereof;

second gears spaced along said second output shaft for engagement with the bottoms of alternate ones of said drive shafts to cause rotation thereof;

means for selectively positioning each of the display elements with a predetermined display surface thereof in the display plane, said means being characterized by a plurality of clutch means each individual to one of the display elements for connecting the display element to the drive shaft means extending therethrough whereby the display element rotates with the drive shaft means;

said clutch means including a pair of frustoconical apertures formed in the opposite ends of each display element;

a pair of frustoconical clutch members each received in the frustoconical aperture formed in one end of one of the display elements;

means securing at least one of the frustoconical clutch members for rotation with the rotary drive shaft means extending through the display element;

means biasing one of said frustoconical clutch members into its respective frustoconical aperture in the display element; and means individual to each display element for selectively terminating rotation thereof with a predetermined display surface of the display element located in he display plane.

15. The sign display according to claim 14 further characterized by means for effecting different rotation of said first and second output shafts and thereby rotating the display elements without encountering interference between adjacent columns of elements during rotation thereof.

16. The sign display of claim 15 and further comprising:

washer means rigidly attached to said drive shaft means for supporting the bottom one of said clutch members associated with a display element above said washer means, and spring means biased against said washer means and the upper clutch member in the display element below said washer means.

17. The sign display according to claim 14 wherein the display element locating means is further characterized by:

a plurality of locating members mounted on the display element for rotation therewith; and stop means for selective engagement with the locating members to terminate rotation of the display element with a predetermined display surface thereof situated in the display plane.

18. The sign display according to claim 17 wherein the locating means comprise abutment surfaces extending axially from the lower end of each display element, and wherein the stop means includes an arm normally positioned in the rotational path of a predetermined abutment surface and means for selectively pivoting the arm out of the rotational path of the predetermined abutment surface and in the path of a remaining abutment surface.

19. A three sided display element for use in a display sign comprising:

a body having a triangular cross-section to form three substantially planar display surfaces and further having opposed end surfaces;

aperture means in at least one end surface of said body for receiving clutch structure; and a continuous groove formed in one end surface of said body and having inner and outer groove walls which are generally perpendicular to said end surface, first and second abutment surfaces integrally formed in one of said groove walls and a third abutment surface formed in the other of said groove walls, each of said abutment surfaces oriented and associated with a different one of said display surfaces in order to enable positioning of selected display surfaces.

20. The three sided display element of claim 19 wherein said groove is formed in the bottom end of said body.

21. The three sided display element of claim 20 and further comprising a cammed surface leading to said third abutment surface.

22. The three sided display element of claim 19 and further comprising an aperture extending through the center axis of said body, said aperture having at least one flat surface along the length thereof.

23. A display element assembly for a changeable sign comprising:

a body having a triangular cross-section to form three substantially planar display surfaces, three abutment surfaces formed on the lower end of said body;

a drive shaft extending through said body;

clutch means connected for rotation with said drive shaft and biased against said body to cause rotation of said body;

said clutch means including symmetrical apertures having circular cross-sections formed in the end of said body;

a pair of clutch members having portions corresponding in shape to and fitting into said apertures;

apertures formed in each of said clutch members for receiving said drive shaft;

a support plate fixedly attached beneath said body;

an arm pivotally attached to said support plate and having a first end portion for abutting against said abutment surfaces to terminate rotation of said body to selectively position said display surfaces;

a solenoid mounted on said support plate and connected to a second end portion of said arm for selectively moving said arm between two positions;

a motor connected to rotate said drive shaft in either of two directions;

wherein any one of said display surfaces may be selectively displayed upon combined operation of said solenoid and said motor.

24. The display element assembly of claim 23 wherein said drive shaft extends through an aperture formed in said support plate.

25. The display element assembly of claim 24 and further comprising:

an upturned flange disposed around said aperture in said support plate and extending upwardly into said counterbore in the lower one of said clutch members.

26. The display element assembly of claim 23 and further comprising:

washer means rigidly attached to said drive shaft and received within the counterbore of the lower one of said clutch members.

27. The display element assembly of claim 26 and further comprising:

a spring biased against the underside of said washer means.

28. A sign display comprising:

a plurality of triangular display elements positioned in columns and rows to define a display matrix; each of said display elements rotatable about an axis independently of any other display element;

each of the display elements haing substantially planar first, second and third display surfaces;

the first display surfaces of all of the display elements defining in combination a predetermined dedicated sign display having a plurality of colors;

the second display surface of each of the display elements comprising a predetermined color;

the third display surface of each display element comprising a contrasting color;

the display elements being mounted for rotation about spaced, parallel axes each extending through one of the columns of display elements, each of said axes being defined by drive means for effecting rotation of the display elements comprising the column, each of the display elements further including clutch means for connecting the display elements to the drive means for rotation therewith, and further including means for selectively terminating rotation of each display element relative to the drive means extending therethrough and independent of adjacent display elements on the same axes under the action of the clutch means when a predetermined display surface of the display element is positioned in the display plane, and the first display surfaces of all of the display elements being selectively position able in the display plane to display the predetermined dedicated sign and the second and third display surfaces of predetermined display elements being selectively position able independent of adjacent display elements in the display plane to display any one of a large number of different desired signs comprising a matrix display of the contrasting colors of the second and third display surfaces of the display elements.

29. The sign display according to claim 28 wherein the means for selectively terminating the rotation of each display element comprises:

a plurality of locating means mounted on the display element for rotation therewith and each corresponding to the positioning of one of the display surfaces of the display element in the display plane;

stop means mounted for selective engagement with the locating means to terminate rotation of the display element when a predetermined display surface thereof is positioned in the display plane; and means for selectively engaging the stop means with the locating means.

30. A sign display comprising:

a plurality of triangular display elements positioned in columns and rows to define a display matrix, wherein the display elements are mounted for rotation about spaced, parrallel axes each extending through one of the columns of display elements, each of said axes being defined by drive means for effecting rotation of the display elements comprising the column;

each of the display elements having substantially planar first, second, and third display surfaces;

the first display surfaces of all of the display elements defining in combination a predetermined dedicated sign display;

the second display surface of each of the display elements comprising a predetermined color;

the third display surface of each display element comprising a contrasting color; and means for selectively positioning a predetermined display surface of each display element in a display plane;

clutch means for connecting the display elements to the drive means for rotation therewith;

a plurality of locating means mounted on one end of the display element for rotation therwith and each corresponding to the positioning of one of the display surfaces of the display element in the display plane;

a pivotally supported stop arm having a tab depending therefrom, said tab defining locating surfaces on the opposite sides thereof for selective engagement with the locating means of the display element; and means for selectively engaging the stop arm with the locating means.

31. A sign display comprising:

a plurality of display elements positioned in rows and columns to define a display matrix;

each of the display elements being triangular in cross-section and having three substantially planar display surfaces;

drive shaft means extending through the display elements of each column substantially parallel to the display surfaces thereof;

clutch means individual to each display element for connecting the display element to the drive shaft means for rotation therewith, the clutch means including a pair of frustoconical apertures formed in the opposite ends of the display element; a pair of frustoconical clutch members received in the frustoconical apertures of the display element; the drive shaft means extending through the frustoconical clutch members and the frustoconical apertures; means securing one of the furstoconical clutch members to the drive shaft means for rotation therewith; and means biasing the other frustoconical clutch members into frictional engagement with the display element; and means associated with each display element for selectively terminating rotation thereof when a predetermined display surface of the display element is positioned in a display plane.

32. The sign display according to claim 30 wherein the clutch means is further characterized by:

means securing the frustoconical clutch members against relative rotation; and means permitting relative axial movement between the frustoconical clutch members under the action of the biasing means to accommodate for wear.

33. The sign display according to claim 30 wherein the means for selectively terminating rotation of each display element with a predetermined display surface in the display plane is further characterized by:

a plurality of locating means each mounted on the display element for rotation therewith and each corresponding to the positioning of a predetermined display surface in the display plane; and stop means mounted for pivotal movement between first and second positions wherein it engages predetermined locating means to terminate rotation of the display element with a predetermined display surface thereof in the display plane.

34. The sign display according to claim 33 wherein the locating means comprises a plurality of pins mounted for rotation with the display element and extending axially therefrom.

35. The sign display according to claim 34 wherein the engagement of the stop means with the pins comprising the locating means depends on the pivotal positioning of the stop arm and on the direction of rotation of the locating means.

36. A sign display comprising:

a plurality of display elements mounted in rows and columns to define a display matrix characterized by a display plane;

each of the display elements having at least two display surfaces characterized by contrasting colors;

drive shaft means extending through the display elements of each of the columns of the display matrix for rotation about predetermined axes;

each of the display elements having opposed frustoconical apertures formed in the opposite ends thereof;

frustoconical clutch members received in each of the frustoconical apertures of the display elements for cooperation therewith to define clutch means for frictionally engaging the display elements with the drive shaft means for rotation therewith;

one of the frustoconical clutch members in each display element being secured to the drive shaft means extending therethrough;

means extending from each of the frustoconical clutch members for preventing relative rotation therebetween;

means biasing the other frustoconical clutch member of each display element into its respective frustoconical aperture and thereby accommodating wear;

a plurality of locating members mounted for rotation with each display element and each corresponding to a display surface of the display element; and a plurality of stop mechanisms each individual to one of the display elements and each mounted for selective engagement with the locating members of the display element to selectively terminate rotation of the display element with a selected display surface thereof positioned in the display plane of the display matrix.

37. The sign display according to claim 36 wherein the frustoconical clutch members each have interfitting members extending therefrom to prevent relative rotation between the clutch members while permitting relative axial movement therebetween to accommodate wear of the clutch members.

38. The sign display according to claim 36 wherein the locating members comprise pins extending axially from each display element, and wherein the stop mechanism includes an arm normally positioned in the rotational path of predetermined ones of the pins and means for selectively pivoting the arm into the rotational path of predetermined other pins.

39. The sign display according to claim 38 wherein the arm comprises and L-shaped arm supported for pivotal movement about an axis extending parallel to the axis of rotation to the display element, and further including solenoid means for selectively pivoting the L-shaped arm about its axis of pivotal movement.

40. The sign display according to claim 36 wherein each display element comprises first, second and third display surfaces, wherein the first display surfaces of all of the display elements cooperate to form a dedicated sign when they are aligned with the display plane, and wherein the second and third display surfaces of each display element comprise contrasting colors.

41. A sign display comprising:

a plurality of display elements positioned along rows and columns extending in perpendicular directions to define a matrix display characterized by a display plane;

each of the display elements being triangular in cross-section and having first, second and third display surfaces;

the first display surfaces of all of the display elements comprising in combination a dedicated sign having predetermined indicia thereon;

the second display surfaces of each display element comprising a first predetermined color;

the third display surface of each display element comprising a second predetermined, contrasting color;

means supporting the display elements for rotation about the axes extending in one of the perpendicular directions; and a plurality of rotary drive shaft means extending along the axes of rotation of the display elements;

a plurality of clutch means each individual to one of the display elements for connecting the display element to the drive shaft means extending therethrough whereby the display elements rotates with the drive shaft means, the clutch means further including a pair of frustoconical apertures formed in the opposite ends of each display element; a pair of frustoconical clutch members each received in the frustoconical aperture formed in one end of the display elements; means securing one of the frustoconical clutch members to the rotary drive shaft means extending through the display element; means constraining the frustoconical clutch members against relative rotation while permitting relative axial movement therebetween to accommodate for wear; and means biasing the other frustoconical clutch members into its respective frustoconical aperture in the display element; and means individual to each display element for selectively terminating rotation thereof with a predetermined display surface of the display element located in the display plane.

* * * * *

UNITED STATES PATENT AND TRADEMARK OFFICE

CERTIFICATE OF CORRECTION

PATENT NO. : 4,021,946

DATED : May 10, 1977

INVENTOR(S) : James T. Bradshaw

It is certified that error appears in the above–identified patent and that said Letters Patent are hereby corrected as shown below:

Col. 15, line 57, "position able" should be --positionable--;
lines 60-61, "position able" should be --positionable--.
Col. 17, lin 5, "Claim 30" should be --Claim 31--;
line 12, "Claim 30" should be --Claim 31--.

Signed and Sealed this

*Fourth* Day of *October 1977*

[SEAL]

*Attest:*

RUTH C. MASON
*Attesting Officer*

LUTRELLE F. PARKER
*Acting Commissioner of Patents and Trademarks*